United States Patent [19]

Steinhagen

[11] 4,004,778

[45] Jan. 25, 1977

[54] PORTABLE ROOF WINCH

[76] Inventor: George J. Steinhagen, 7119 W. Roma, Phoenix, Ariz. 85033

[22] Filed: Mar. 29, 1976

[21] Appl. No.: 671,088

[52] U.S. Cl. ..... 254/142; 182/155; 182/184; 212/48; 212/59 R

[51] Int. Cl.[2] ..... B66C 23/72

[58] Field of Search ..... 254/142, 139.1; 280/758, 759; 212/48, 49, 55, 59 R, 144; 214/142; 182/155, 184, 142

[56] References Cited

UNITED STATES PATENTS

| | | | |
|---|---|---|---|
| 2,506,896 | 5/1950 | Shakowitz | 182/155 |
| 2,893,299 | 7/1959 | Moir | 212/49 X |
| 3,007,540 | 11/1961 | Reinhardt | 182/142 X |
| 3,103,344 | 9/1963 | Figge | 254/142 |

*Primary Examiner*—Robert J. Spar
*Assistant Examiner*—Donald W. Underwood
*Attorney, Agent, or Firm*—John A. Robertson

[57] ABSTRACT

A portable roof winch comprising a collapsible frame that is adjustable to accommodate the slant of a roof, an extensible beam consisting of two telescoping parts one of which is pivotally mounted on the frame on a vertical axis and the other part being moveable with respect to the pivot and having a manually operable winch mounted thereon at a location adjacent to and spaced from the free end of the moveable part, together with a seat for an operator on the moveable part beyond the winch. A cable is taken up on the winch, extends along the beam and is passed over a pulley at the free end cf the fixed beam part. A load engaging hook is attached to the end of this cable.

7 Claims, 9 Drawing Figures

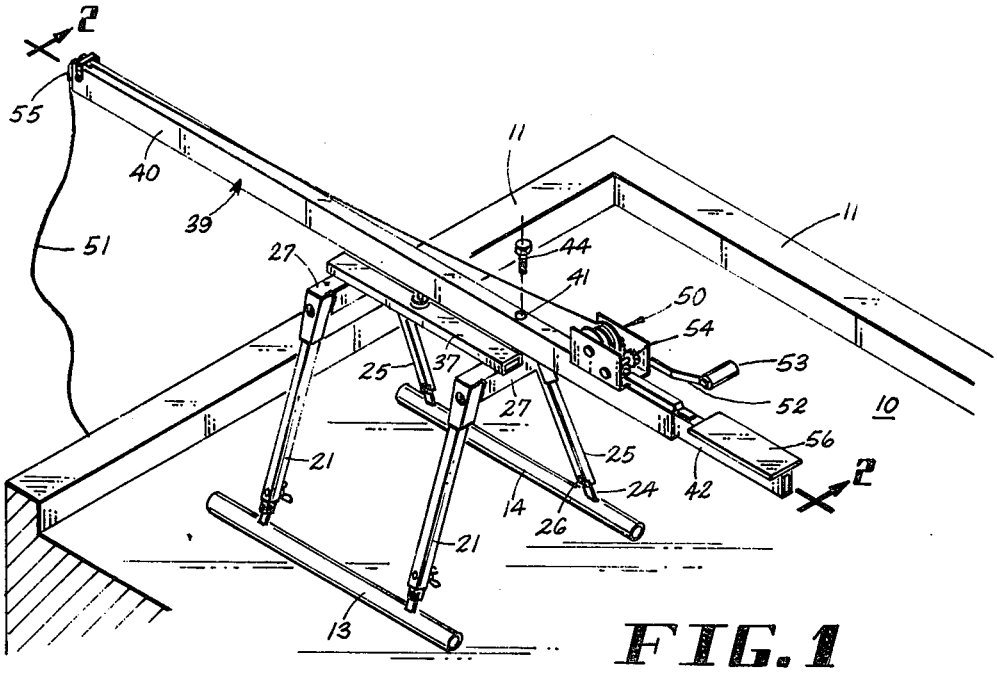
FIG. 1
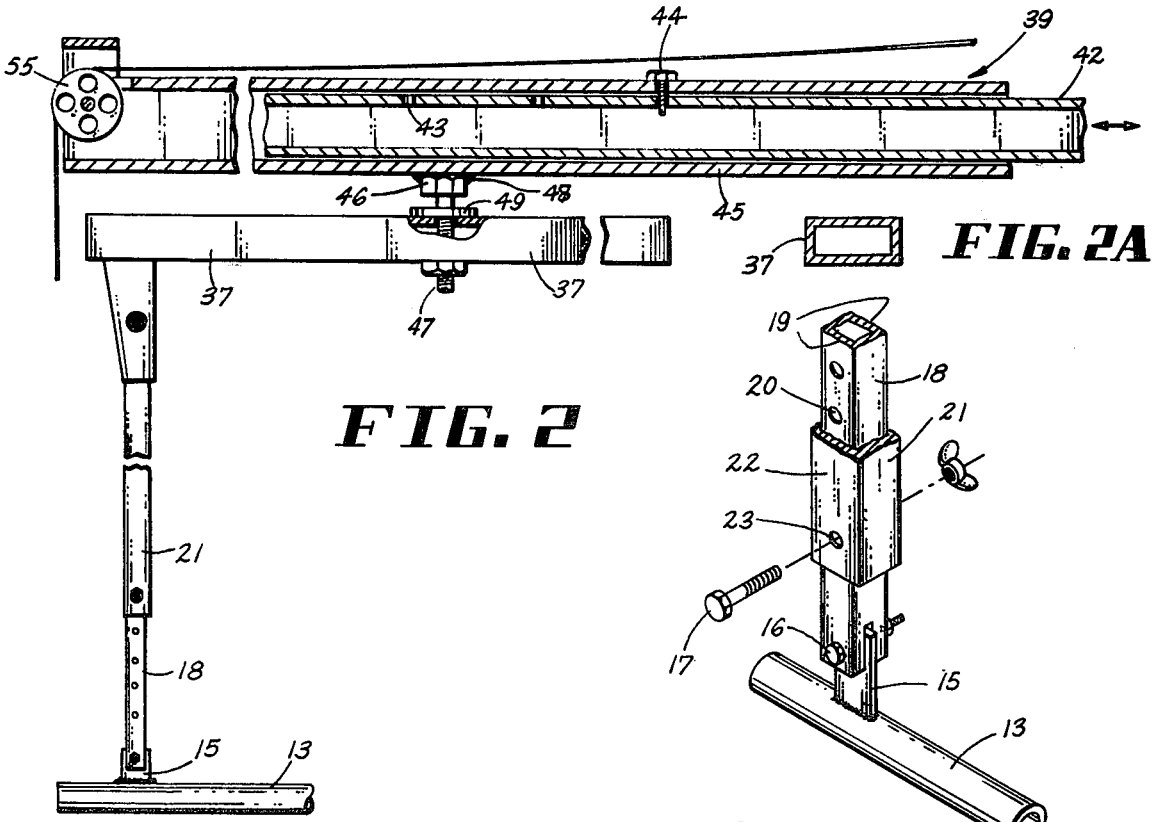
FIG. 2A
FIG. 2
FIG. 3 to counterbalance the load. As the load will only be a slight distance above the roof surface, it may then be lowered by swinging the beam on a horizontal axis as provided by the universal joint. The load could also be deposited by simply releasing the ratchet which is included as part of the winch.

For a full and more complete understanding of the invention, reference may be had to the following description and accompanying drawings, wherein:

FIG. 1 is a perspective of the portable roof winch of this invention shown as being erected on a flat roof and in position for hoisting a load thereto.

FIG. 2 is a side view showing a portion of the frame in elevation and the extensible beam in longitudinal vertical section.

FIG. 2A is a vertical section through the median beam.

FIG. 3 is a detailed perspective depicting the pivotal connection of the lower end of an adjustable leg to the base bar together with the structure that renders this leg adjustable in length.

Figure 8:
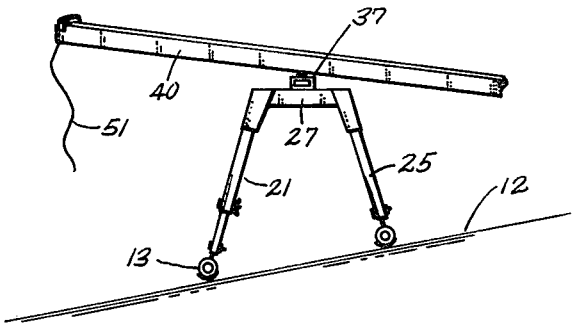
FIG. 8 is a side elevation largely diagrammatic, showing the subject roof winch as installed on a slanted roof.

Referring now to the drawings wherein like reference characters are used to denote corresponding elements throughout the several views, it is noted that FIG. 1 discloses a building having a flat roof 10 having edges at 11. At this point it is well to note that the instant winch is designed for use on a slanted roof such as shown at 12 in FIG. 8 or on the ridge of a roof of inverted V shape. To facilitate describing the instant winch, reference will be made more particularly to the flat roof of FIG. 1.

A pair of base bars 13 and 14 are preferably tubular and may be covered with a sleeve (not illustrated) which inhibits sliding movement thereof relative to roof 10.

Referring now more particularly to FIGS. 2 and 3, a pair of tabs 15 upstand from base bar 13 and pivotally mounted thereon by bolt 16 is a leg member 18 that is tubular and square shaped in cross section. Tubular member 18 presents a pair of opposed side walls 19 formed with a series of aligned apertures 20. Tubular member 18 is slideably received in a tubular leg 21 having opposed walls 22 formed with aligned apertures 23 which are adapted to align with any of the apertures 20. When so aligned a bolt 17 is passed through the aligned apertures and a nut applied thereto to fix an adjusted length of leg 21.

Figure 4:
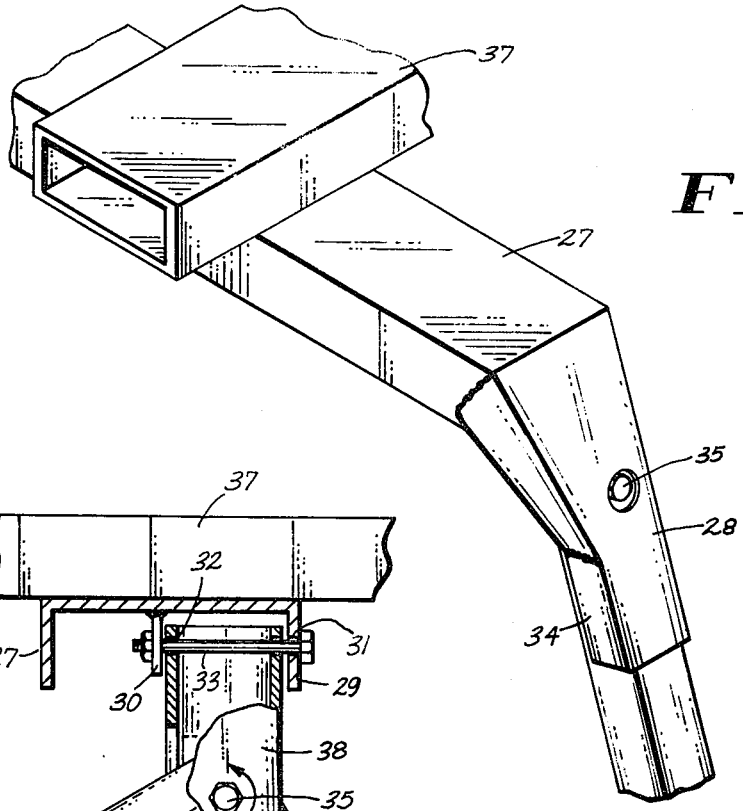
FIG. 4 is another detailed perspective taken on an enlarged scale illustrating how the upper end of a leg is held in a vertical plane common to the cross bar.
Figure 5:
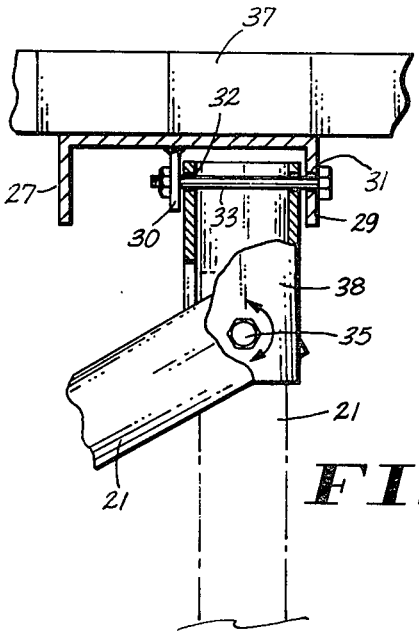
FIG. 5 is a detail, part in section and part in elevation showing how a leg is moved into and out of engagement with the holding device therefor and swung into a position in which it extends in the direction of a base bar.
Figure 6:
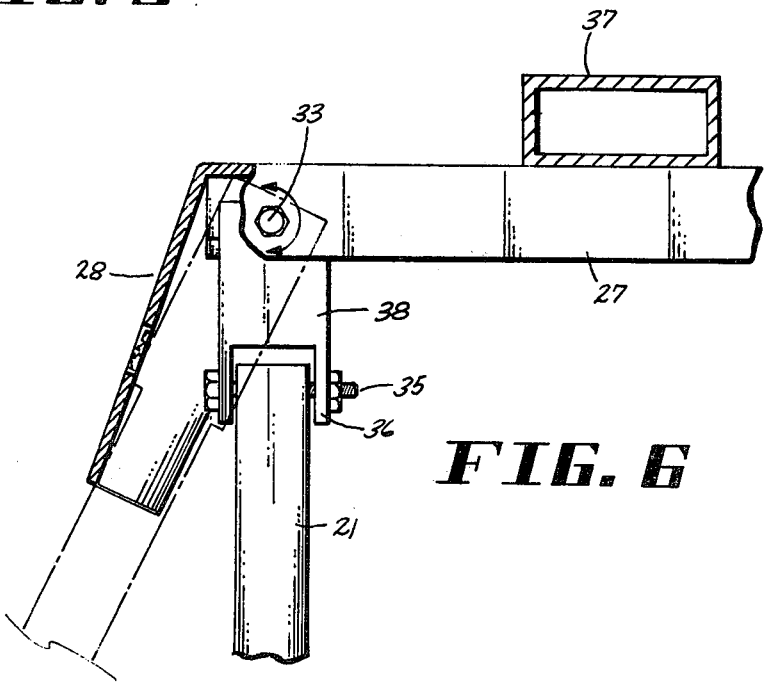
FIG. 6 is a view taken normal to the showing of FIG. 5.
Figure 7:
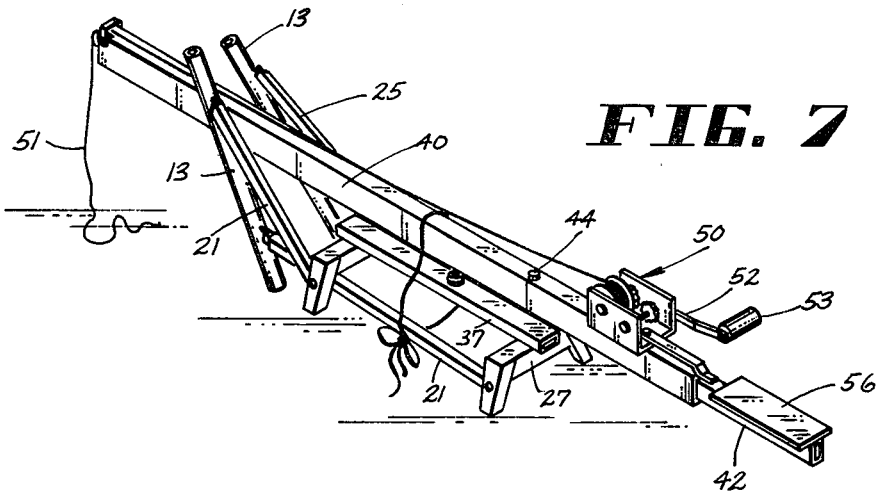
FIG. 7 is a perspective depicting the subject portable roof winch in a collapsed position.

Upstanding from base bar 14 are a second pair of tabs 24 to each of which the lower end of a leg 25 is pivotally connected as indicated at 26. Each of a pair of cross bars 27 is connected to the upper ends of legs 21 and 25. All of these connections are pivotal which permits all of the legs to be swung in the general direction of the longitudinal extent of base bars 13 and 14 into the position of FIG. 7. However, in the position of FIG. 1 these bars are held or locked in a position in which this swinging movement is inhibited. The mechanism for providing this action is illustrated in FIGS. 4, 5, and 6. As all of these pivotal connections are the same, only one of them is herein described.

Depending from each end of a cross bar 27 is a channel like member 28, the channel of which opens inwardly that is toward the cross bar 27. As shown in FIG. 5, the latter is also of channel construction and opens downwardly. Thus, it presents a flange 29 at one side having a bracket 30 depending from the back of the channel. Flange 29 and bracket 30 are formed with aligning openings one of which is shown at 31. The upper end of a leg such as indicated at 21 is also formed with aligned openings 32 which align with openings 31. A pivot bolt 33 passes through these aligned openings. Thus, leg 21 may be swung inwardly into a position in which it is free of engagement with side flanges 34 of channel member 28. When so positioned the leg 21 may be swung in the direction indicated by the arrows in FIG. 5 into the collapsed position. This swinging action is provided by a pivot bolt 35 which is shown more clearly in FIG. 6 and which passes through aligned orifices in leg 21 and end flanges on upper part 38 of leg 21 which are spaced from the orifices 32 and arranged in a direction normal to orifices 32 and parts 36 of member 28.

Connected to the upper side of cross bars 27 and central thereof is a median bar 37 which preferably is of tubular and rectangular in cross section as depicted in FIG. 2A. An extensible beam is referred to in its entirety by reference character 39. It comprises two telescopic parts. One of these is an outer part 40 which is tubular and rectangular in cross section. It presents an upper wall formed with an aperture 41 (FIG. 1) and an inner part 42 which is also tubular in cross section and formed with a series of apertures 43, any one of which is adapted to align with aperture 41. Thus, the telescopic parts 40 and 42 of extensible beam 39 may be moved relative to one another to provide a desired extent of extensible beam 39. This extent is fixed by dropping a pin 44 through the aligned apertures.

Outer part 40 has a bottom wall 45 to which the head 46 of a bolt 47 is attached as by welding indicated at 48. Bolt 47 passes through median bar 37 centrally thereof through holes in the walls of bar 37 which are slightly larger than the diameter of bolt 47. A spacing washer 49 is interposed between head 46 and median bar 37 thus providing a joint between extensible beam 39 and median bar 37 which has slight characteristics of a universal joint in that beam 39 may be tilted slightly on a horizontal axis due to the loose fit of bolt 47 and washer 49.

It is evident that the distance between the free end of outer part 40 and the pivotal joint at 49 is fixed whereas the distance between the outer end of inner part 42 and the pivotal joint is adjustable.

A winch is indicated at 50. Manually operable winches are well known and hence details are not herein illustrated. It is sufficient to point out that they ordinarily include a reel on which a cable 51 is wound, a crank arm 52 having a handle 53 for rotating the winch, and a ratchet and pawl mechanism 54. Cable 51 passes over a pulley 55 on the free end of beam part 40 and has a load engaging hook (not illustrated) at its free end.

It will be understood that it is desirable to make as many of the parts of the above described apparatus of

PORTABLE ROOF WINCH

The present invention relates to portable winches and is concerned primarily with a winch that is particularly designed to be erected on a roof but is collapsible to permit its being carried to a roof up a ladder by a workman.

BACKGROUND OF THE INVENTION

At the present time, mechanics and other workmen engaged in jobs on a roof face a necessity of raising large loads such as those ranging in the order of 100 to 300 pounds to the roof. An example of such a load is an air conditioner. Ordinarily, mechanics of this type do not have available hoisting apparatus such as a crane for getting the load to the roof and the general practice has been for the mechanic or workman to carry the load up a ladder. Such an operation is not only highly inconvenient and cumbersome but also subjects the workman to excessive fatigue.

At the present time so far as the applicant is aware there is no winch or comparable hoisting device, which is, in the first instance, collapsible and of light weight so that it may be readily carried up a ladder by a single workman and then erected on a roof and includes an extensible beam which is pivotally mounted on a frame with a winch on a moveable part of the beam and a pulley on the end of the fixed part of the beam which extends beyond the roof edge when the frame is erected and a seat for an operator of the winch which is positioned so that the weight of the operator to a great extent counterbalances or off-sets the load being hoisted. The present invention is founded on the basic concept of providing a portable roof winch having the above characteristics.

OBJECTS OF THE INVENTION

With the foregoing conditions in mind the present invention has in view the following objectives:

1. To provide a portable roof winch which is particularly adapted to be readily carried up a ladder to a roof, erected thereon, and includes an extensible beam on which a manually operable winch is mounted, together with a seat for an operator on the end of the beam opposite to a fixed end having a pulley thereon.

2. To provide, in a portable roof winch of the type noted, a light weight collapsible frame including four legs, two of which are adjustable to accommodate the slant of a roof.

3. To provide, in a portable roof winch of the character aforesaid, an extensible beam comprising two telescoping parts one of which is pivotally mounted on a vertical axis on the frame and the other of which telescopes therein and carries the winch and operator's seat adjacent to its free end.

4. To provide a portable roof winch, of the kind described, in which the extent of the fixed beam part of the beam from the pivot to its free end is fixed together with a pulley on this free end and a cable that is taken up on the winch, passed over the pulley and has a load engaging hook at its free end.

Various other more detailed objects and advantages of the invention, such as arise in connection with carrying out the above ideas in a practical embodiment will, in part, become apparent and in part be hereinafter stated as the description of the invention proceeds.

SUMMARY OF THE INVENTION

The foregoing objects are achieved by providing a portable roof winch which includes a collapsible frame. This frame comprises two base bars from one of which upstands a pair of legs having a fixed length and from the other of which upstands a second pair of legs the lengths of which are adjustable. A cross bar extends between an adjustable leg and a fixed leg at one end and a second cross bar between the fixed leg and adjustable leg at the other end. The lower ends of the legs are pivotally mounted to the base bars and the upper ends are pivotally connected to the cross bars to permit swinging movement of the legs together with the base bars attached thereto in the direction of the longitudinal extent of the base bars. Provision is made for locking the legs in vertical planes including the cross bars.

A median bar has its opposite ends fixedly secured to the cross bars centrally of the latter.

An extensible beam comprises a fixed tubular part and a moveable part that telescopes within the fixed part. The fixed part is pivotally mounted to the upper side of the median bar and centrally thereof by a joint which provides for swinging movement of the beam on both vertical and horizontal axes. The term fixed as here used to identify a part of the extensible beam means that the extent of this part from its pivotal mounting to its free end is fixed and is not intended to denote that the part is fixed relative to the frame.

The moveable part carries a manually operable winch adjacent to but spaced from the end of this part which is remote from the pivotal mounting. A seat for an operator of the winch is mounted on the moveable part between the winch and the free end of this part. The telescoping parts of the beam are provided with means for holding them in a relative adjusted position and the moveable part is of greater extent than the fixed part to permit the winch and operator's seat assuming a position at a greater distance from the pivotal mounting than the distance of the free end of the fixed part from this pivot. This enables the achievement of a substantial counterbalancing of the load by the operator on the seat.

A cable is taken up on the winch and runs along the upper side of the beam and passes over a pulley on the free end of the fixed part of the beam. This cable has a load engaging hook attached to its free end.

It is evident that the foregoing portable roof winch may be readily collapsed into a position in which it may be carried up a ladder by a single workman whereupon the frame is erected in position on a roof at which time one set of legs is adjusted to accommodate the cant of the roof so that the median beam assumes a position in which its upper wall is horizontal. The moveable part of the beam is adjusted relative to the fixed part to provide a distance between the pivotal mounting of the beam and the operator's seat which will substantially counterbalance a particular load. The cable is unwound from the winch to the extend necessary to permit the hook to engage the load, the operator then winds up the wheel of the winch to take in the cable and lift the load to a level above the roof edge. He then swings the beam to place the load into position above the roof where it is to be deposited. Should the frame be mounted on the ridge of a roof of inverted V shape, he may remove himself from the seat and swing that end of the beam about as necessary but at the same time placing sufficient pressure on that end of the beam light weight metal as is consistent with providing the required strength and rigidity. It is believed that all of the elements of the collapsible frame may be of aluminum while extensible beam 39 is preferably of steel. A seat for an operator is shown at 56 as being mounted on beam part 42 between the free end thereof and the winch.

OPERATION OF THE PREFERRED EMBODIMENT

While the manner of using, erecting, and operating the subject portable roof winch is believed to be obvious from the illustrations of the drawings and description of parts set forth above, they may be briefly described as follows:

If the winch is to be used on a flat roof such as shown at 10 in FIG. 1, or on the apical ridge of a roof of inverted V shape, the legs 21 are adjusted to be of the same length as the legs 25 whereby when so installed the top wall of median bar 37 will be in a horizontal plane. The frame is collapsed into the position of FIG. 7 by first swinging the legs on pivot bolt 33 to disengage them from the walls 34 of members 28. They are then swung on pivot bolts 35 into the position of FIG. 7.

The frame in its collapsed position is carried up a ladder by a workman. It is then erected in position on a flat roof as shown in FIG. 1 or an apical ridge of a V shaped roof. If it is being installed on a slanted roof such as shown at 12 in FIG. 8, the effective lengths of legs 21 are adjusted so that they have a length greater than the legs 25. This is accomplished by operating the mechanism shown in FIG. 3 in a well known manner. With the frame properly erected, cable 51 is unwound from the reel of the winch and the hook thereon engaged with a load. This attachment may be achieved by a person other than the operator because it is so simple. If the operator is alone, he descends the ladder, engages the hook and again climbs the ladder whereupon he assumes a position on seat 56. However, before assuming his position on the seat the beam 39 is extended to a length commensurate with the weight of the load and the particular operator. Thus, with the operator on the seat beam 39 should provide sufficient leverage or mechanical advantage whereby the load is substantially counterbalanced by the weight of the operator.

The operator on the seat then grasps handle 53 to rotate the reel of the winch and take up cable 51 on the reel. The load is thus hoisted to a height above roof edge 11 whereupon the operator swings the beam 39 about bolt 47 as a pivot into a position in which the load is over the location on the roof where it is to be deposited. It is possible that this action may take place with the operator still seated if his feet engage the roof. However, in the case of the roof having an apical ridge, it may be necessary for him to remove himself from the seat and swing the beam. Should such a maneuver be necessary he will continue to make a large amount of his weight effective on the beam by pressing downwardly on the seat with his hands. The load is then lowered onto the roof which is readily accomplished by simply relieving weight on the seat and the action of the loose fit of the bolt 47 and washer 49. It could also be accomplished by merely releasing the ratchet of the winch.

While a preferred specific embodiment of the invention is herein disclosed it is to be clearly understood that the invention is not limited to the exact constructions, mechanisms, and devices illustrated and described because various modifications of these details may be provided in putting the invention into practice.

What is claimed is:

1. In a portable roof winch, a. a collapsible frame for erection on a roof and including a bar which assumes a horizontal position when the frame is erected;

b. an extensible beam secured to said bar by a pivotal mounting and comprising two telescopic parts one of which is secured to said pivotal mounting and presenting a free end and the other of which is moveable relative to said pivotal mounting and having a free end;

c. a pulley on the free end of said part which is secured to the pivotal mounting;

d. a manually operable winch carried by the telescopic part that is moveable relative to said pivotal mounting and located adjacent to but spaced from the free end of that telescopic part;

e. an operator's seat on the telescopic part on which said winch is mounted between the free end of that part and the winch;

f. mechanism for holding said telescopic parts of the extensible beam in an adjusted position; and g. a cable that is taken up on said winch passes over said pulley, and has a free end with load engaging means thereon whereby counterbalance is supplied by the weight of an operator sitting on the seat.

2. The portable roof winch of claim 1 in which said pivotal mounting is a joint providing swinging movement of the beam on vertical and horizontal axes.

3. The portable roof winch of claim 2 in which the pivotal mounting comprises a bolt having a head secured to one of the telescopic parts of the beam and passes through holes in the median bar which are larger than the diameter of the bolt to provide a loose fit between the median bar and the bolt, a spring washer between the head of the bolt and said median bar, and a nut on said bolt.

4. The portable roof winch of claim 1 in which said collapsible frame comprises:

I. a pair of base bars engaging a roof when the frame is erected thereon,

II. a pair of legs of fixed lengths pivoted to one of said base bars,

III. a pair of legs the lengths of which are adjustably pivoted to the other of said base bars, IV. a pair of cross bars each of which is pivotally connected to the upper end of a leg of fixed length and the upper end of a leg the length of which is adjustable, V. releasable means for holding the two legs pivoted to a cross bar in a vertical plane common to the cross bar to which they are connected, and VI. a median bar extending between and attached to said cross bar, said median bar constituting the bar of element (a) of claim 1.

5. The portable roof winch of claim 4 in which each of the legs which are adjustable in length comprise two telescopic members one of which is pivoted to a base bar and the other to a cross bar together with means for securing said telescopic members in an adjusted position.

6. The portable roof winch of claim 1 in which the part of the extensible beam to which the pivotal mounting is secured is the outer of the telescopic parts and slideably receives the other of the telescopic parts which is thereby constituted the inner telescopic part.

7. The portable roof winch of claim 6 in which the mechanism for holding the telescopic parts of the extensible beam in an adjusted position comprises an aperture in said outer part, a series of apertures in said inner part any one of which is adapted to align with the aperture in said outer part, and a pin removeably positioned in said apertures when so aligned.

* * * * *